US012577802B2

(12) United States Patent
O'Molony et al.

(10) Patent No.: US 12,577,802 B2
(45) Date of Patent: Mar. 17, 2026

(54) TENSILE MEMBRANE STRUCTURE BUILDING SYSTEM

(71) Applicant: Tenthouse Structures (Pty) Ltd, Cape Town (ZA)

(72) Inventors: Brendan James O'Molony, Cape Town (ZA); Sydney Rainer Horn, Cape Town (ZA); Drew Beattie, Cape Town (ZA); Ryan Vivier Higgo, Cape Town (ZA)

(73) Assignee: Tenthouse Structures (Pty) Ltd, Cape Town (ZA)

( * ) Notice: Subject to any disclaimer, the term of this patent is extended or adjusted under 35 U.S.C. 154(b) by 177 days.

(21) Appl. No.: 18/696,627

(22) PCT Filed: Sep. 29, 2022

(86) PCT No.: PCT/ZA2022/050051
§ 371 (c)(1),
(2) Date: Mar. 28, 2024

(87) PCT Pub. No.: WO2023/056489
PCT Pub. Date: Apr. 6, 2023

(65) Prior Publication Data

US 2024/0384561 A1 Nov. 21, 2024

(30) Foreign Application Priority Data

Oct. 1, 2021 (GB) ..... 2114134

(51) Int. Cl.
*E04H 15/64* (2006.01)
*E04B 1/24* (2006.01)
(Continued)

(52) U.S. Cl.
CPC ..... *E04H 15/642* (2013.01); *E04B 1/2403* (2013.01); *E04B 1/5831* (2013.01);
(Continued)

(58) Field of Classification Search
CPC ..... E04H 15/642; E04H 15/18; E04H 15/644; E04H 15/64; E04B 1/2403; E04B 1/5831;
(Continued)

(56) References Cited

U.S. PATENT DOCUMENTS 3,811,454 A 5/1974 Huddle
4,118,904 A * 10/1978 Sprung ..... E04H 15/648 52/63

(Continued)

FOREIGN PATENT DOCUMENTS

EP 1635075 3/2006
EP 2664231 11/2013

(Continued)

OTHER PUBLICATIONS

PCT International Search Report and Written Opinion issued in International Application No. PCT/ZA2022/050051, mailed Dec. 16, 2022.

*Primary Examiner* — Rodney Mintz
(74) *Attorney, Agent, or Firm* — pH IP Law

(57) ABSTRACT

A tensile membrane structure building system (10) including several standard extruded structural members (12) of the same cross-sectional profile. These standard structural members (12) have a rectangular cross-sectional profile with four sides (50.1-50.4) oriented at right angles to each other at four corners (52.1-52.4), each side including formations that define at least one channel (54) extending along a length of the structural members. By means of fasteners (80) that cooperate with the channels, standard structural members may be interlocked so as to form a framework (14). Each side of the standard structural member also include two slots (58) located on either side of the channel or channels towards the corners, the slots configured to receive and hold an edge of a membrane (16).

18 Claims, 12 Drawing Sheets

(51) Int. Cl.
*E04B 1/58* (2006.01)
*E04H 15/18* (2006.01)

(52) U.S. Cl.
CPC ..... *E04H 15/18* (2013.01); *E04B 2001/2415* (2013.01); *E04B 2001/2418* (2013.01); *E04B 2001/5881* (2013.01)

(58) Field of Classification Search
CPC ..... E04B 2001/2415; E04B 2001/2418; E04B 2001/5881; E04B 2001/2406; E04B 2001/2451; E04B 2001/2457; E04B 2001/2463; E04B 2001/2475; E04B 2001/2481; E04B 2001/249; E04B 2001/5856; E04B 1/342
See application file for complete search history.

(56) References Cited

U.S. PATENT DOCUMENTS 4,137,687 A * 2/1979 Sprung ..... E04H 15/32 52/63
4,229,914 A * 10/1980 Lucas ..... E04B 1/3441 52/63
7,849,639 B2 * 12/2010 Sprung ..... E04H 15/644 52/63
9,181,692 B1 * 11/2015 Callaway ..... E04F 19/024
9,334,644 B2 * 5/2016 Harnois ..... E04B 1/34321
9,797,156 B2 * 10/2017 Neumann ..... E04H 15/505
9,797,426 B2 * 10/2017 Flaig ..... B23P 19/04
9,988,805 B1 * 6/2018 Smith ..... E04C 3/40
10,161,146 B2 * 12/2018 Maintz ..... E06B 9/0692
10,174,507 B1 * 1/2019 Henbid ..... E04F 13/005
10,352,033 B2 * 7/2019 Smith ..... E04H 15/14
10,914,060 B2 * 2/2021 Smith ..... E04C 3/28
11,332,919 B2 * 5/2022 Smith ..... E04H 15/54
11,773,581 B2 * 10/2023 Smith ..... E04C 3/06 52/63
2006/0101730 A1 * 5/2006 Sprung ..... E04H 15/644 52/82
2007/0023076 A1 2/2007 Eide et al.
2015/0010343 A1 1/2015 Flaig
2015/0233107 A1 * 8/2015 Harnois ..... E04B 1/34384 52/63
2015/0233139 A1 * 8/2015 Neumann ..... E04H 15/18 135/122
2016/0298345 A1 * 10/2016 Maintz ..... E04H 15/18
2018/0238043 A1 * 8/2018 Kuramoto ..... A01G 9/227
2018/0245330 A1 * 8/2018 Smith ..... E04C 3/06
2019/0284791 A1 * 9/2019 Smith ..... E04H 15/54
2021/0164216 A1 * 6/2021 Smith ..... E04C 3/40
2022/0275630 A1 * 9/2022 Smith ..... E04C 3/28
2023/0366231 A1 * 11/2023 Lentowich ..... E04H 15/64

FOREIGN PATENT DOCUMENTS

EP 4019713 6/2022
WO WO 2011/130851 10/2011

* cited by examiner

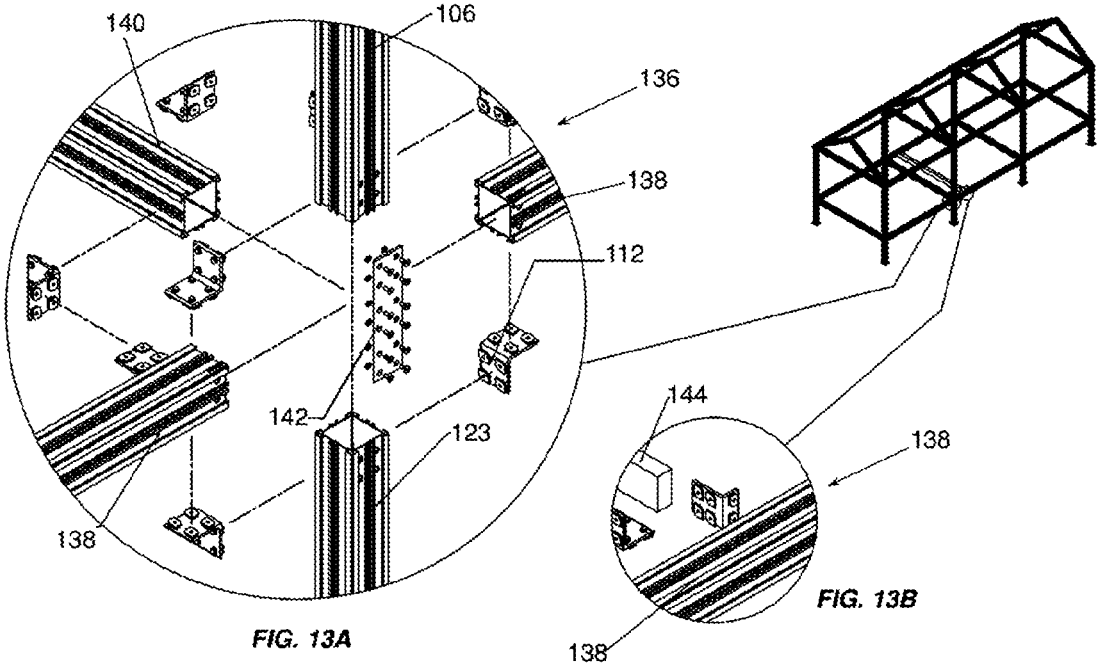
FIG. 13A
FIG. 13B
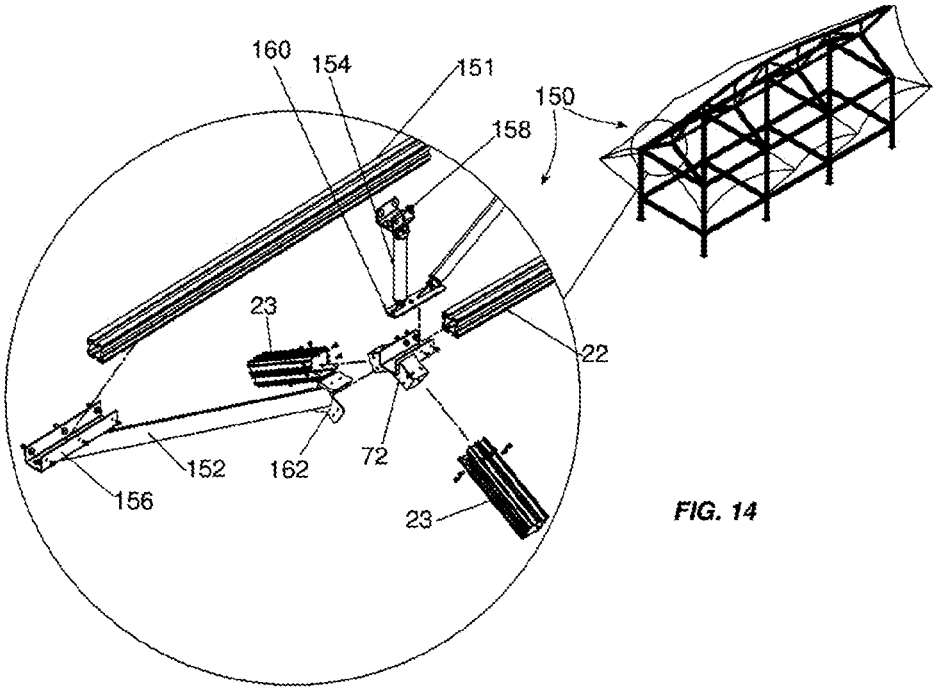
FIG. 14

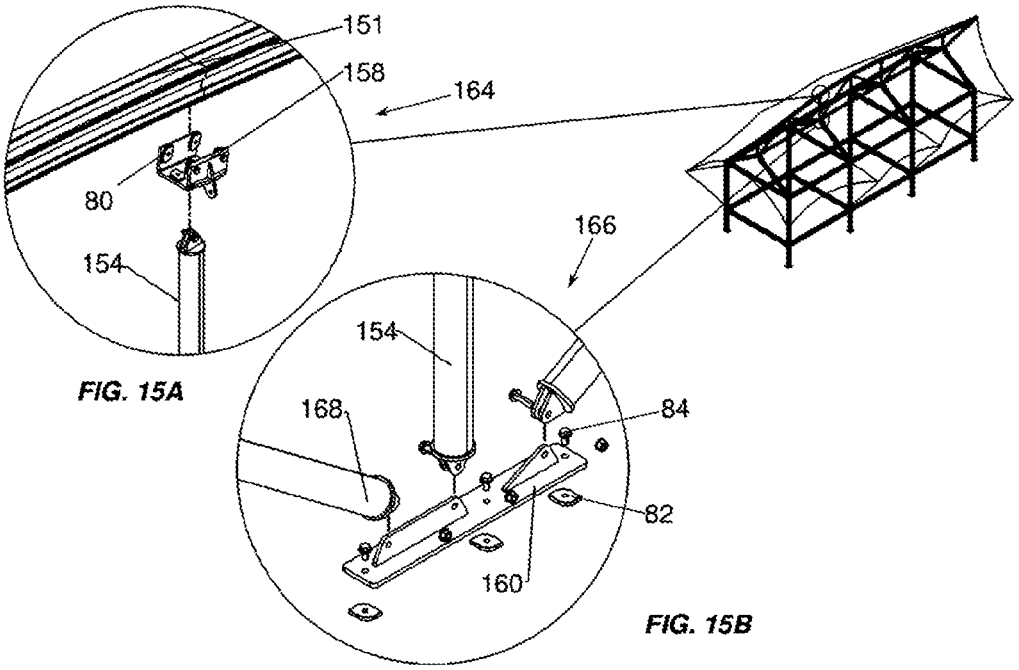
FIG. 15A
FIG. 15B
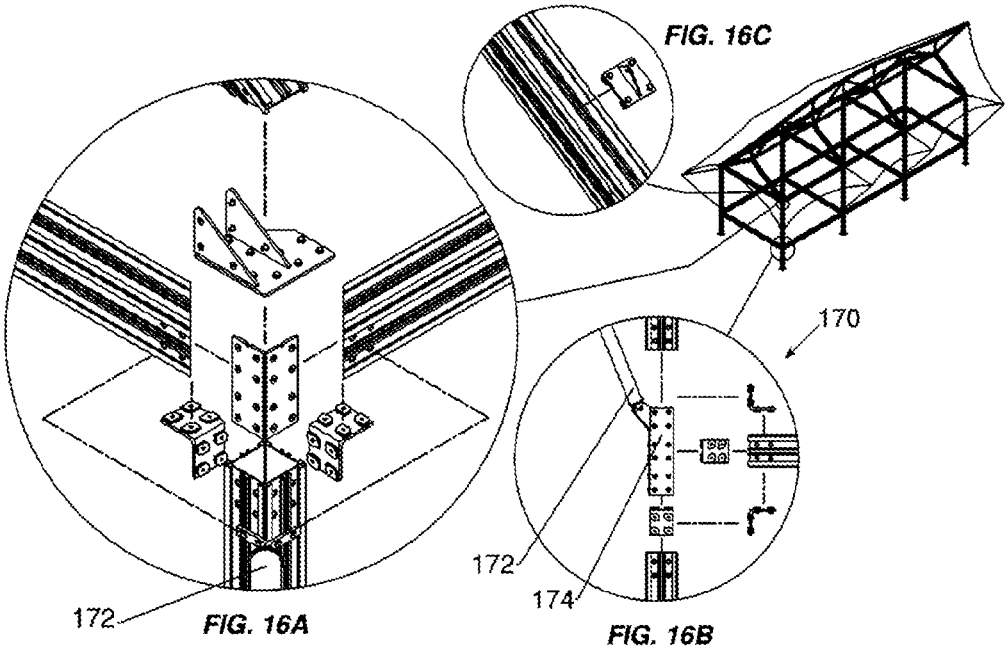
FIG. 16A
FIG. 16B

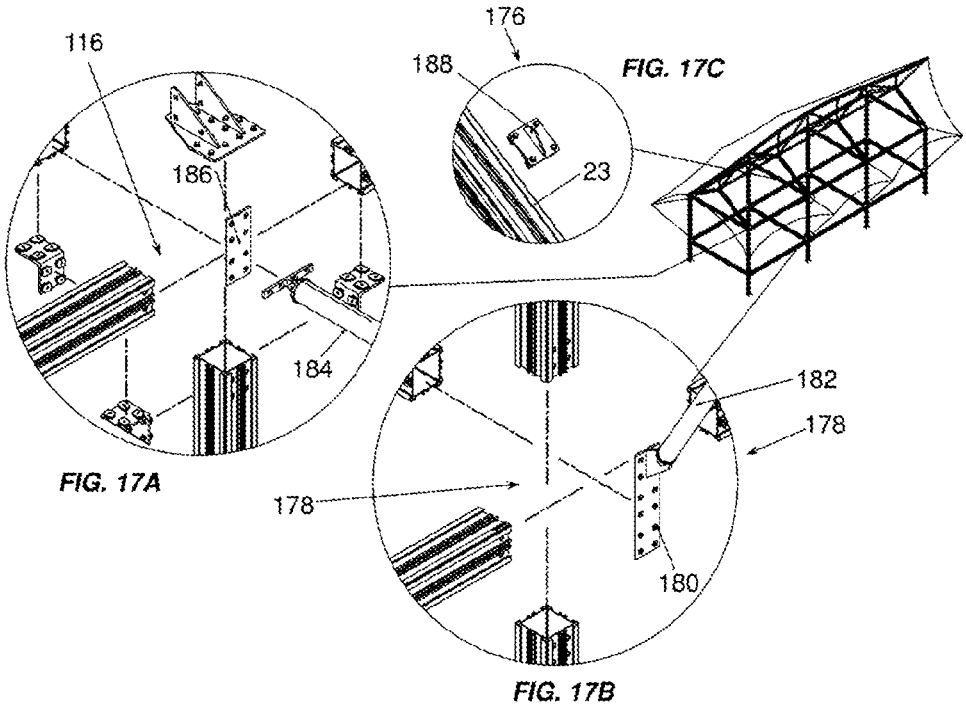
FIG. 17A
FIG. 17C
FIG. 17B
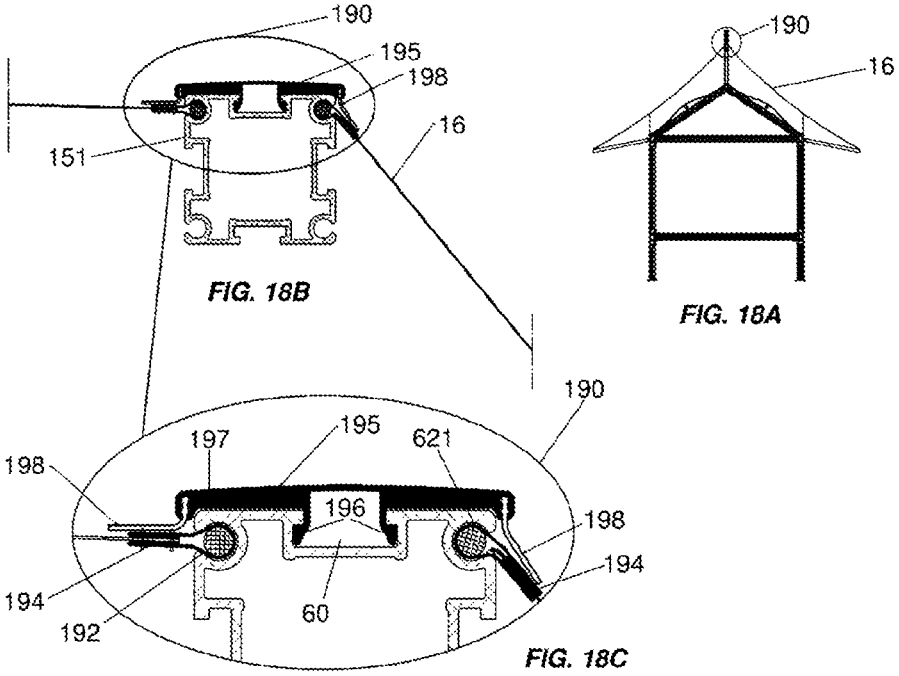
FIG. 18B
FIG. 18A
FIG. 18C

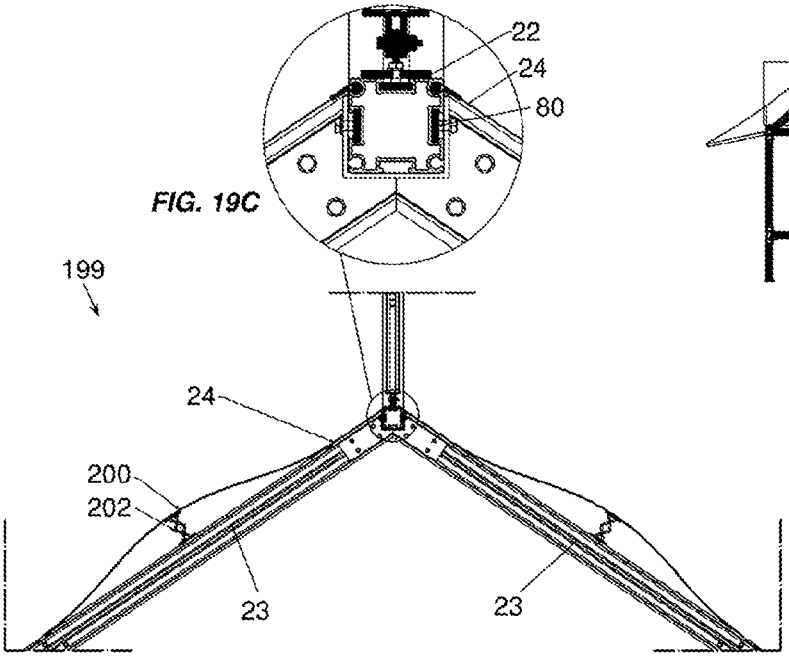
FIG. 19C
FIG. 19B
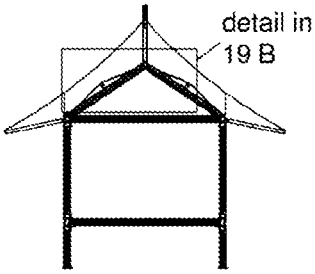
FIG. 19A
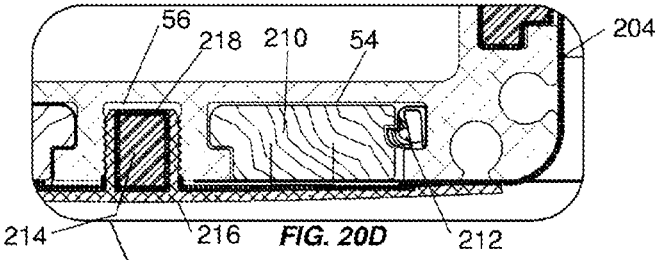
FIG. 20D
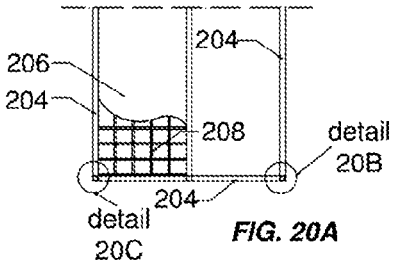
FIG. 20A
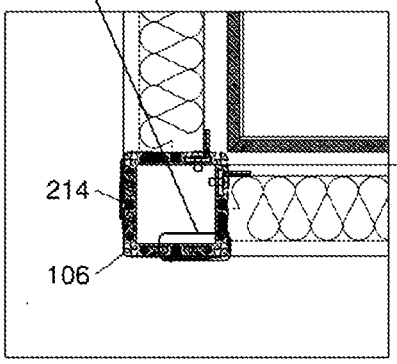
FIG. 20C
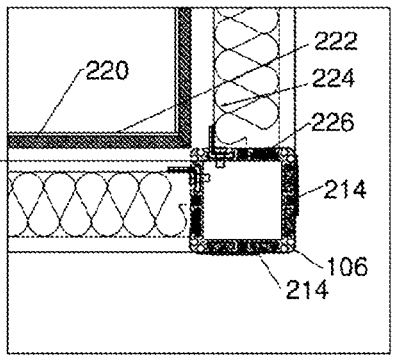
FIG. 20B

TENSILE MEMBRANE STRUCTURE BUILDING SYSTEM

This application is a national phase application under 35 U.S.C. § 371 of International Application No. PCT/ZA2022/050051, filed Sep. 29, 2022, the entire contents of which are hereby incorporated by reference. International Application No. PCT/ZA2022/050051 claims benefit of United Kingdom Application No. 2114134.6, filed Oct. 1, 2021.

FIELD OF THE INVENTION

This invention relates to tensile membrane structures, and in particular to a tensile membrane structure building system in which a structure may support a roofing membrane, ceilings, and wall facades under tension.

BACKGROUND TO THE INVENTION

A tensile membrane structure generally includes a rigid structure that supports a membrane such as a fabric or other flexible sheet held under tension. The membrane may be a roof, ceiling, wall, or other structure such as a flyout portion. Examples of tensile membrane structures include stadium roofs, shade structures and tented structures such as tented cabins, lodges, retreats, resorts, villas, or other dwelling structures.

The structure supporting the membrane is generally composed of several compression members such as beams, columns, struts, trusses, and tension elements such as cables and rods, held together by suitable fasteners. In tented structures the beams, columns, struts, and trusses are generally galvanized steel. Connecting components such as welded structural nodes, brackets, plates, and bolts may be manufactured for fastening the galvanized steel members together and building the structure. Typically, the members, fasteners, tension elements and other components are manufactured to specification before being transported to site for assembly.

Different tensile membrane structures each require significant custom manufacturing and detailing of members, connecting components, tension elements and other components. Components such as membrane fastening slotted clips (also termed keder rails) or timber pieces must also typically be screwed onto the beams, requiring extensive drilling and other customization during manufacturing. It would be advantageous to have a flexible system to enable multiple structures to be built with very similar or identical components, thereby requiring less customization at the manufacturing stage. It would also be advantageous if such a system provided for increased ease of assembly on site.

The preceding discussion of the background to the invention is intended only to facilitate an understanding of the present invention. It should be appreciated that the discussion is not an acknowledgment or admission that any of the material referred to was part of the common general knowledge in the art as at the priority date of the application.

SUMMARY OF THE INVENTION

In accordance with the invention there is provided a tensile membrane structure building system comprising a membrane and several standard extruded structural members of the same cross-sectional profile, the cross-sectional profile of the standard structural members being generally rectangular with four sides oriented at right angles to each other at four corners, each side including formations that define at least one channel extending along a length of the structural member by which structural members can be interlocked using connectors that cooperate with the channels so as to form a framework, and each side further including two slots located on either side of the channel or channels towards the corners, the slots configured to receive and hold an edge of the membrane.

The cross-sectional profile of the standard structural members may be square, with the four sides being identical. Each side may have two adjacent channels extending along the length of the structural member, in which case a longitudinally extending groove may be provided between the two adjacent channels. This groove may optionally be ribbed, and the system may include a cover strip having a flat top forming a finished surface and a projection extending along an opposite bottom surface configured to be received in the groove.

The channels may be inwardly lipped, and the connectors may include plates or brackets having fasteners that cooperate with the lipped channels. In one embodiment, a fastener may include a nut and bolt, the nut having a lobed shape such that rotation of the nut engages the inwardly lipped portion of the channel so as to lock the nut within the channel. The nut may have a threaded bore for receiving an end of the bolt so as to permit the nut to be rotated by the bolt.

The slots towards the corners may have a part-circular shape and be undercut, and the membrane may include a bolt rope forming an enlarged edge of the membrane. The bolt rope edge of the membrane may be capable of being threaded into the slots.

The system may include an extruded apex beam having a rectangular cross-sectional profile with four sides oriented at right angles to each other at four corners, each side including formations that define at least one channel extending along a length of the apex beam by which the apex beam can be interlocked with standard structural members using connectors that cooperate with the channels, and each side further including two slots located on either side of the channel or channels towards the corners, the slots configured to receive and hold an edge of a roof or ceiling membrane. The apex beam profile may also be used for a ridge beam in the system.

The slots of the apex beam may be larger than the slots of the standard structural member so as to accommodate tensile forces which may be present in the roof of ceiling membranes which attach to the apex beam.

The system may also include a weatherproof cover strip having a pair of clips that locate the cover strip in a channel, a covering portion sized to extend across a side of the beam, and a pair of flaps fastened adjacent an edge of the covering portion.

Additional components of the system may include a channel insert with a cooperating spring clip for holding the channel insert in a channel, the channel insert preferably being made from wood.

The invention extends to a tensile membrane structure comprising a framework supporting a membrane, wherein the framework includes several extruded standard structural members of the same cross-sectional profile, the cross-sectional profile of the standard structural members being generally rectangular with four sides oriented at right angles to each other at four corners, each side including formations that define at least one channel extending along a length of the structural member by which structural members can be interlocked using connectors that cooperate with the channels so as to form the framework, and each side further including two slots located on either side of the channel or channels towards the corners, the slots configured to receive and hold an edge of the membrane.

The invention yet further extends to a method of building a tensile membrane structure, comprising: providing several extruded standard structural members of the same cross-sectional profile, the cross-sectional profile of the standard structural members being generally rectangular with four sides oriented at right angles to each other at four corners, each side including formations that define at least one channel extending along a length of the structural member and two slots located on either side of the channel or channels towards the corners, interlocking standard structural members by means of connectors that cooperate with the channels to form a framework, and threading a bolt rope edge of a flexible membrane into a slot which receives and holds the membrane under tension.

Embodiments of the invention will now be described, by way of example only, with reference to the accompanying drawings.

BRIEF DESCRIPTION OF THE DRAWINGS

In the drawings:

FIGS. 13A and 13 B show a floor mid beam node and an adjacent joist node;

FIG. 14 is a key view and exploded view of a ridge end/apex beam connection;

FIGS. 15A and 15B show a ridge beam roof truss node and an apex beam roof truss node;

FIGS. 16A, 16B and 16C illustrate an example of a corner outrigger node;

FIGS. 17A, 17B and 17C show an illustrative mid outrigger top node and bottom node;

FIGS. 18A, 18B and 18C show roof ridge detail;

FIGS. 19A, 19B and 19C show a hermetic membrane ceiling and tensioner system;

FIGS. 20A to 20D illustrate fabric walls in top view;

DETAILED DESCRIPTION WITH REFERENCE TO THE DRAWINGS

A tensile membrane structure building system may include a membrane and several standard extruded structural members of the same cross-sectional profile. These standard structural members may have a rectangular cross-sectional profile with four sides oriented at right angles to each other at four corners, each side including formations that define at least one channel extending along a length of the structural members. By means of connectors that cooperate with the channels, standard structural members may be interlocked so as to form a framework. Each side of the standard structural member may also include two slots located on either side of the channel or channels towards the corners, the slots configured to receive and hold an edge of the membrane. Various other connectors and components can then be fixed to the standard structural members in order to build a tensile membrane structure.

Figure 1:
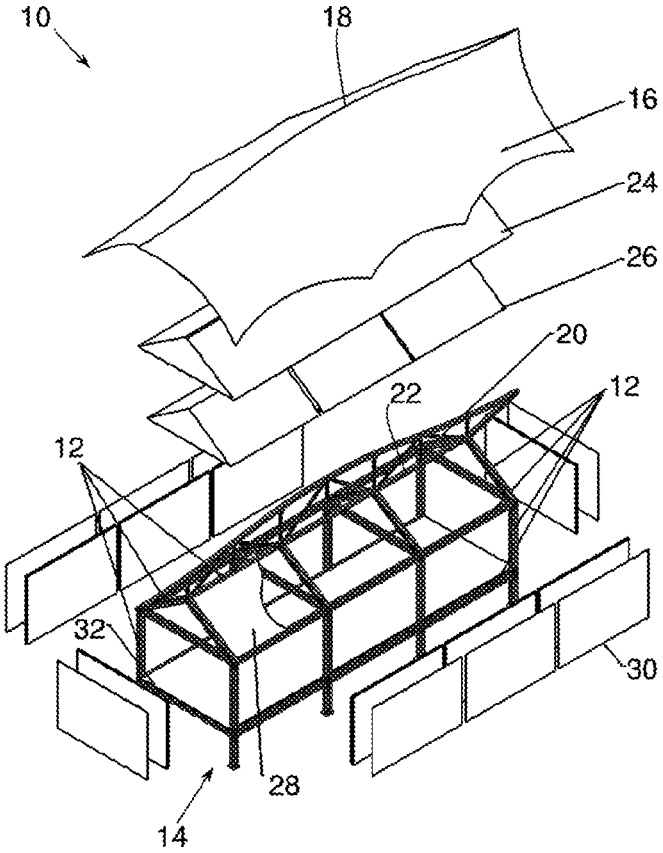
FIG. 1 is an exploded view of a tensile membrane structure building system.

FIG. 1 illustrates an exemplary tensile membrane structure building system (10), which in this example is for a tented structure such as a tented cabin. The system (10) includes several standard extruded structural members (12) which interlock to form a framework (14) which supports membranes (16) under tension. The extruded structural members (12) may be aluminium extrusions formed in standard lengths that are cut to appropriate sizes and machined 10 at connection points on manufacture. The membrane (16) may be a fabric membrane which forms an external roof or covering. The membrane (16) may have a seam (18) with a bolt rope (also known as a keder) along its top ridge and may be supported along this seam (18) by a composite steel and aluminium truss (20), thus giving the membrane (16) a ridge style appearance. The truss (20) is mounted atop an apex beam (22) of the framework (14), the apex beam (22) supporting a hermetic membrane (24), inner ceilings (26) and thermal panels (28). Fabric walls (30) are held between standard structural members (12) along the sides of the framework (14), and a flooring system (32) extends along a bottom.

Figure 2:
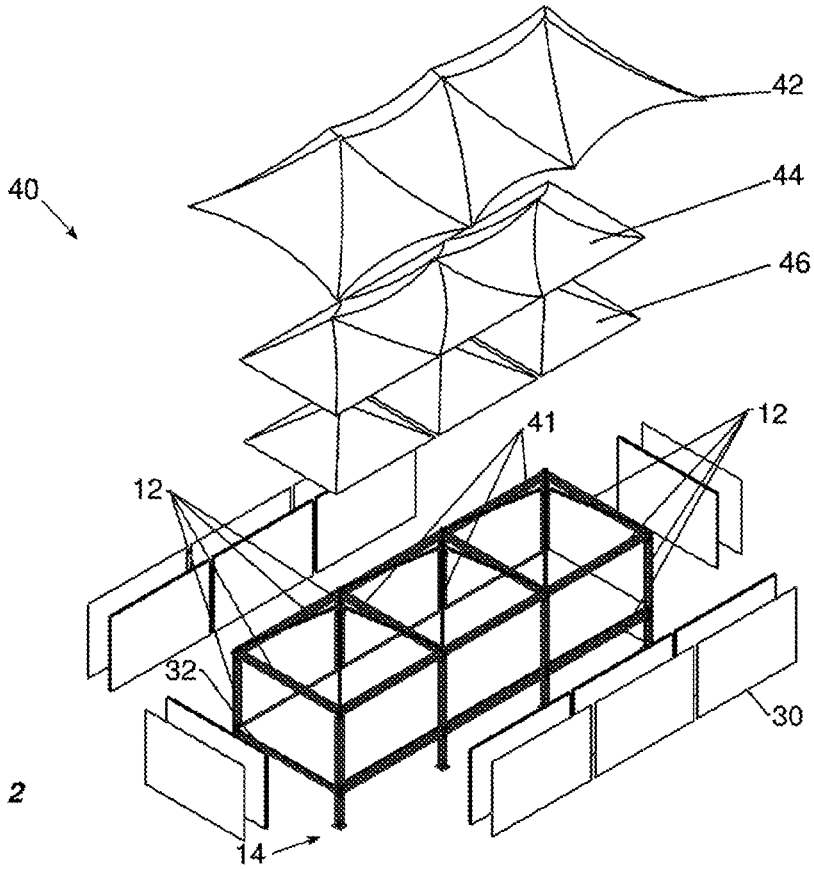
FIG. 2 is similar to FIG. 1 but of a different style.

FIG. 2 illustrates a second exemplary tensile membrane structure building system (40) wherein like reference numerals refer to like components. Instead of an apex beam, the system (40) includes steel rafters (41) which define a number of peaks which cooperate with a peaked roof membrane (42). A hermetic membrane (44) and inner ceilings (46) are provided which also cooperate with the rafters (41). The basic structure of the framework (14), however, is the same as in FIG. 1 including the standard structural members (12) which form the framework (14). The fabric walls (30) and floor system (32) are also the same.

Figure 3:
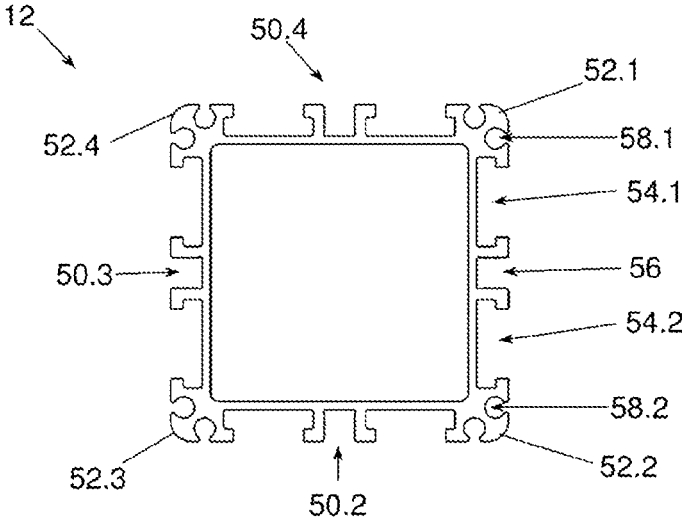
FIG. 3 is a cross section of an extrusion forming a standard structural member.

The framework (14) can be largely constructed using the standard structural members (12) and various ancillary components. FIG. 3 illustrates an embodiment of the standard structural member (12) shown in cross-section. The structural member (12) may be an extruded aluminium member thereby enabling features such as lipped channels and undercut grooves to be formed during extrusion manufacturing.

The standard structural member (12) may be rectangular with four sides (50.1, 50.2, 50.3 and 50.4) oriented at right angles to each other at four corners (52.1, 52.2, 52.3, 52.4). In this embodiment, the cross-sectional profile of the standard structural member (12) is square and the four sides (50.1, 50.2, 50.3, 50.4) are identical. Each side has two adjacent channels (54.1, 54.2) extending along the length of the structural member. The channels (54.1, 54.2) are inwardly lipped, and may also be termed U-channels or U-rails. A longitudinally extending groove (56) is provided between each pair of adjacent channels (54.1, 54.2), the groove (56) optionally being ribbed.

Each side may further include two slots (58.1, 58.2), located on either side of the channels (54.1, 54.2) towards the corners (52.1, 52.2). The slots are configured to receive and hold an edge of a membrane as will be described in detail below.

The standard structural member (12) may be used within the framework (14) for rafters, eaves beams, columns, stub beams and floor beams as will be described. The apex beam (22), however, may be formed from a different extruded aluminium profile shown in FIG. 4, the apex beam (22) therefore forming an additional optional component in the tensile membrane structure building system (10). The apex beam (22) may also be square but may have only one channel (60) in each side. Pairs of slots (62.1, 62.2) may be formed in two opposite sides (64.1, 64.2) of the apex beam (22) whereas the other two sides (64.3, 64.4) have only channels (60). The slots (62.1, 62.2) in the apex beam may be larger than those of the standard structural member as they may be designed to hold a roof membrane edge, which may be under higher tension than other membranes such as wall membranes for which the standard beam's slots (58) are used.

Figure 4:
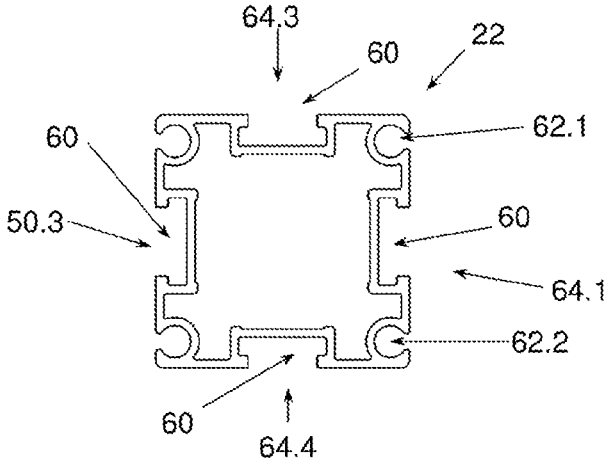
FIG. 4 is a cross section of an extrusion forming an apex beam.
Figure 5:
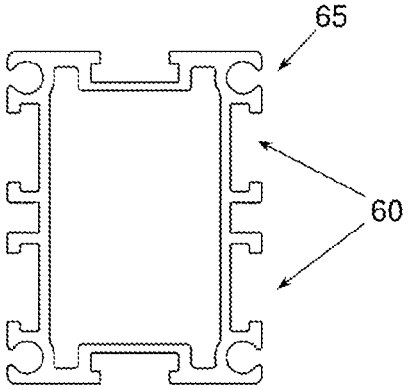
FIG. 5 shows a different embodiment of an apex beam.

FIG. 5 shows a different embodiment of a ridge beam (65) which may be suited to higher loadings than the standard ridge/apex beam (22) of FIG. 4. The ridge beam (65) has a rectangular profile with a height dimension greater than a width dimension, the height dimension including a pair of channels (66) instead of a single channel. The increased height dimension may increase the strength of the ridge beam (65) to loads that tend to bend the beam along a vertical plane.

Figure 6:
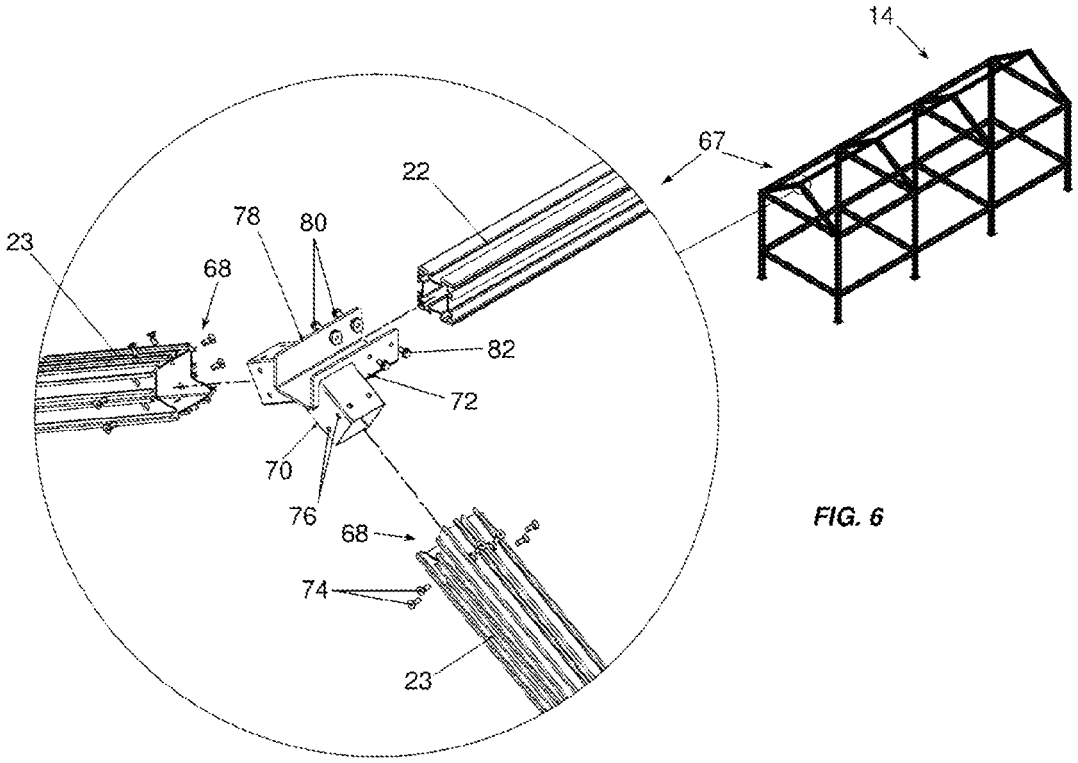
FIG. 6 is a key view and exploded view of an apex beam end node.

The tensile membrane structure building system (10, 40) enables the structural members to be interlocked using connectors that cooperate with the channels. FIG. 6 shows a key view and exploded view of an apex beam end node (67) in a framework (14) similar to the framework shown in FIG. 1. The apex beam end node (67) may include an apex beam (22) as described in FIG. 4 and two standard beams (12) that form rafters (23). The two rafters (23) are illustrated with their free ends (68) cut into a V-shape and sliding over complementary male projections (70) of a steel rafter connection box node (72) where they are fastened with bolts (74) that fit into holes (76) to secure them to the connection box node (72). An integral bracket (78) receives the apex beam (22) and is secured to it by means of fasteners (80) that cooperate with the lipped channels (54).

Figure 7:
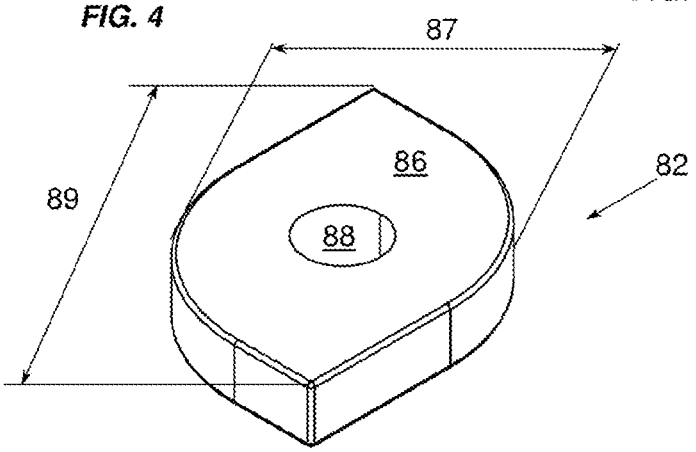
FIG. 7 is a three-dimensional view of a nut of a fastener.

Each fastener (80) may include a nut (82) and a bolt (84). The nut (82) is shown in more detail in FIG. 7 and may include a flat plate (86) with a threaded bore (88) for receiving the bolt. The plate (86) may be narrower in a first dimension (87) than in a perpendicular second dimension (89) and may have a lobed shape. The first dimension (87) may be sized to permit the plate (86) to be inserted into the lipped channel (54) by being narrower than a mouth of the channel, after which the plate (86) can be rotated so that extremities of the plate extend beneath lipped edges of the channel so as to lock the nut (82) within the channel. In this example the nut (82) is leaf-shaped such that it can only turn by approximately 90 degrees before it engages inner surfaces of the lipped channel (54) and cannot rotate further. Tightening of the bolt (84) into the nut (82) then tightens the bracket (78) against the apex beam (22). This swivel nut and bolt fastener arrangement together with the inwardly lipped portion of the channel acts as a friction bolt connection capable of withstanding substantial forces as are required in tensile membrane structures.

Figure 8:
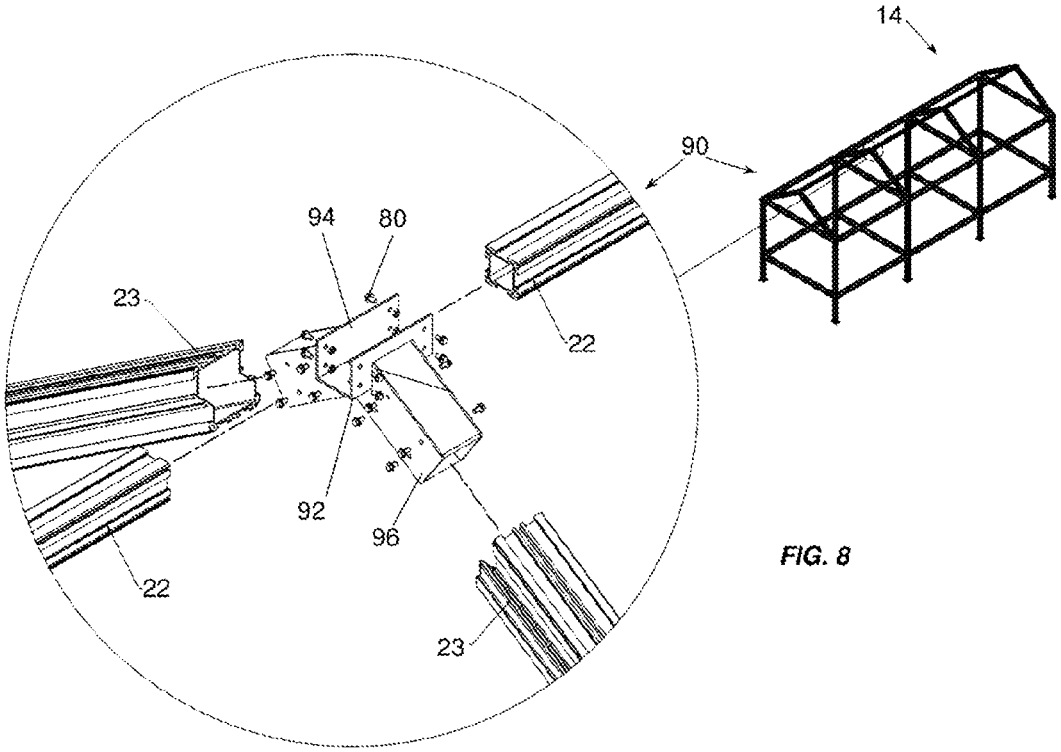
FIG. 8 is a key view and exploded view of an apex beam mid node.

FIG. 8 illustrates an exemplary apex beam mid node (90). Here, two lengths of apex beam (22) may be held together by a connection box node (92). The connection box node (92) works in a similar manner to the connection box node (72) of FIG. 6, except that it has a bracket (94) which includes two sets of fasteners (80) on either side for fixing the two lengths of apex beam (22) to the connection box node (92). The male projections (96) of this connection box node (92) are shown to be longer and have two sets of bolts along their length, to accommodate greater forces that may be applicable, in one example. Rafters (23) are connected to the connection box node (92) in the same way as described in the preceding figure.

Figure 9:
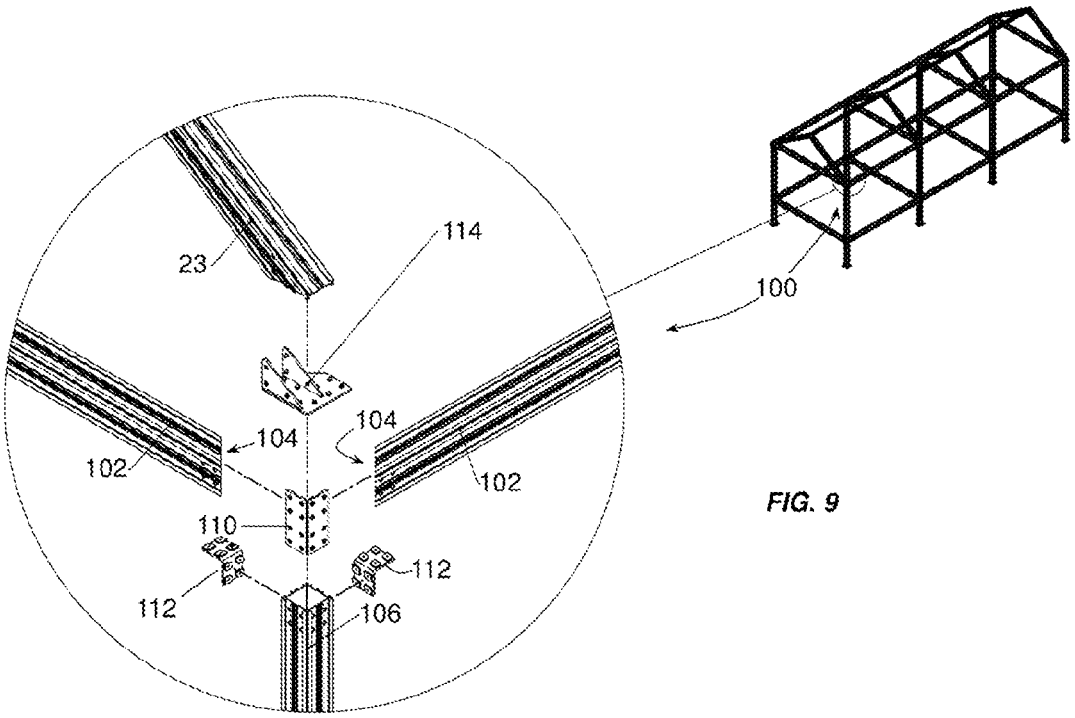
FIG. 9 is a key view and exploded view of an eaves beam corner node.

FIG. 9 shows an exemplary eaves beam corner node (100). Here, four standard structural members (12) meet at the corner node (100). Two standard structural members form eaves beams (102) with mitred front edges (104). The illustrated mitre is a 45 degree mitre to enable the eaves beams (102) to abut at a ninety degree angle to each other. Both a column (106) and a rafter (23) are formed by standard structural members (12). The rafter (23) also has a 45 degree mitre at its free end. An inner bracket (110) and a pair of external brackets (112) attach the column (106) to the eaves beams (102) with bolts extending into the inner bracket (110) and the outer brackets having fasteners (80) as described in FIGS. 6 and 7, the fasteners attaching into the lipped channels (54) of the beams as previously described. A rafter bracket (114) is provided with fasteners (80) of the type described above for fastening the rafter (23) to the two eaves beams (102) by way of the lipped channels (54).

Figure 10:
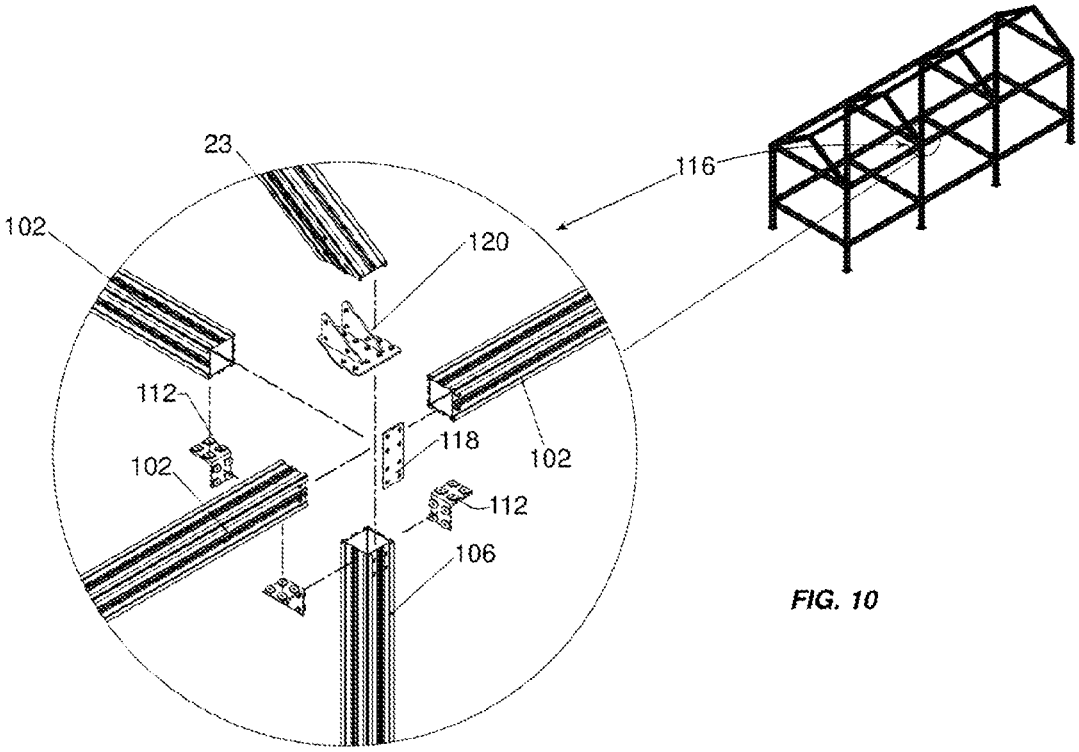
FIG. 10 is a key view and exploded view of an eaves beam mid node.

FIG. 10 illustrates an exemplary eaves beam mid node (116). Since the eaves beams (102) are not mitred here but simply abut each other, an inner plate (118) is provided which is a flat plate with holes for bolts extending through the eaves beams. A bracket (120) includes fasteners (80) for fastening the rafter to the two eaves beams (102) as by way of the lipped channels.

Figure 11:
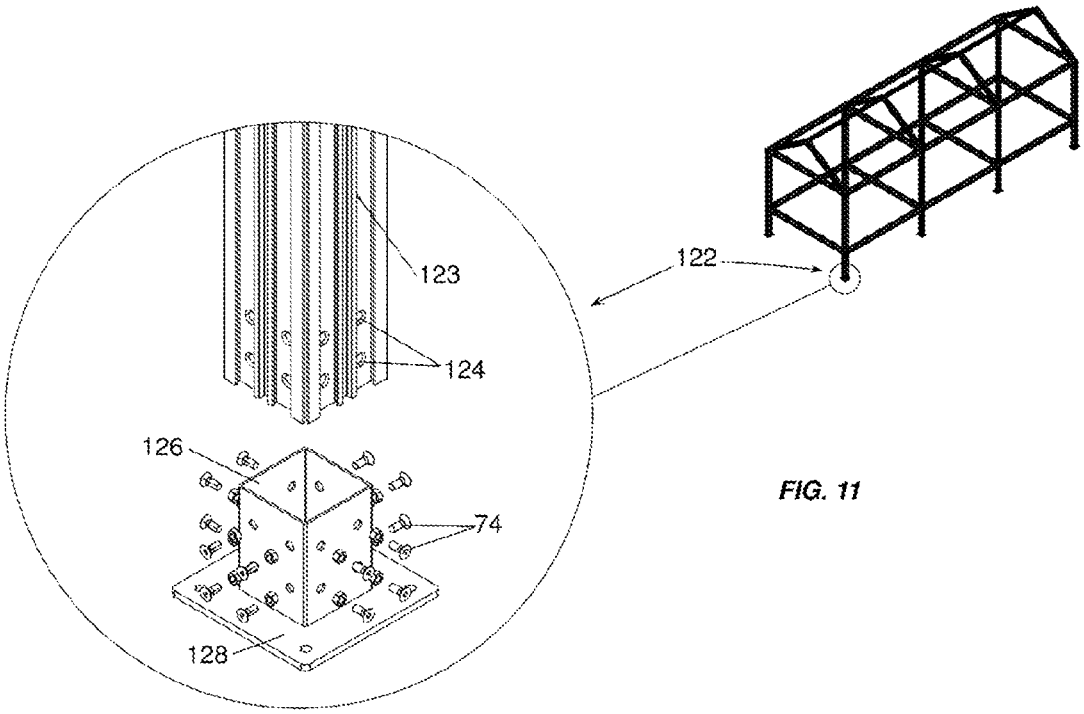
FIG. 11 is a key view and exploded view of a footing node.

FIG. 11 illustrates a footing node (122) of the system according to an embodiment. A stub column (123), which is formed by the standard structural member (12), has a number of holes (124) which align with corresponding holes in a foot piece (126). Bolts (74) extend through the aligned holes to keep the foot piece (126) in place.

Figure 12:
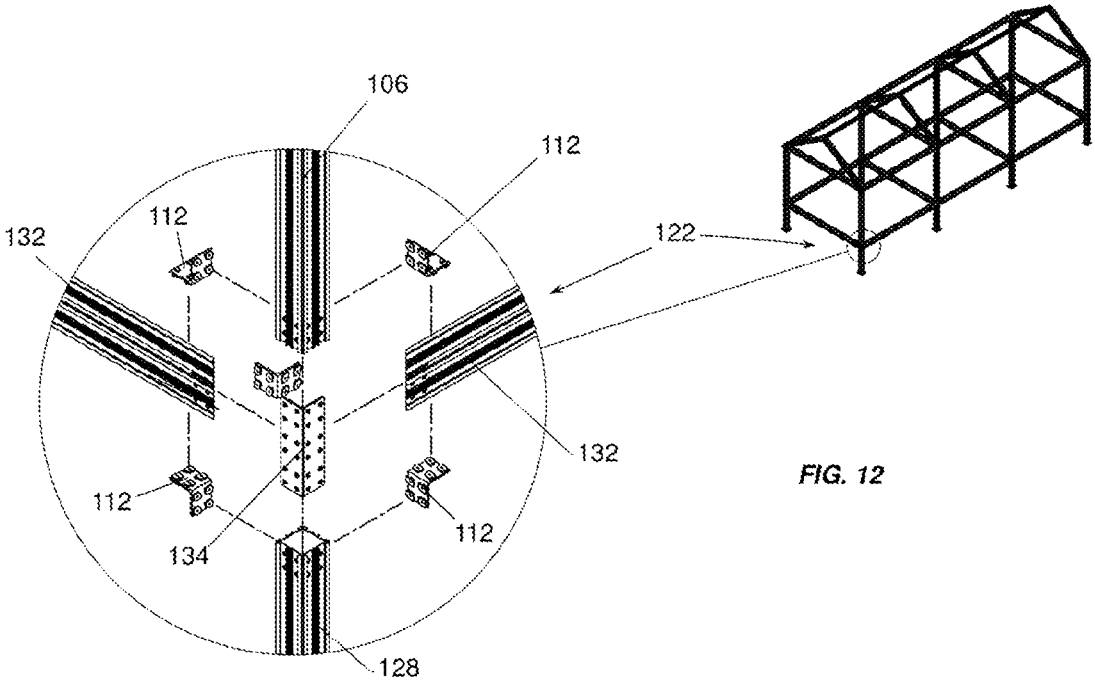
FIG. 12 is a key view and exploded view of a floor beam corner node.

FIG. 12 illustrates an exemplary floor beam corner node (130) where the stub column (123), column (106), and two mitred floor beams (132), all formed from sections of standard structural members (12), meet. The structural members are attached together by means of an inner bracket (134) and by four external brackets (112) of the type previously described. The inner bracket (134) is an angled plate and fits half within the stub column (123) and half in the main column (106) with bolts extending into the angled plate.

In FIG. 13A, an exemplary floor mid beam node (136) is shown, with FIG. 13B showing an adjacent joist node (138). At the floor mid beam node (136), two floor beams (138), a floor tie beam (140), a stub column (123) and a main column (106) are fastened together. All of these members are standard structural member extrusions (12). Fastening is by way of an internal plate (142) and eight external brackets (112) with their fasteners (80) for clamping into the lipped channels (54) as previously described. In FIG. 13B, a floor joist (144) is shown.

Once the framework (14) is constructed, additional components may be required to support the membrane (16) and finish the structure. In particular, a truss (20) may be required in the case of a membrane with a ridge style appearance. FIG. 14 shows a ridge end/apex beam connection (150). A ridge beam (151) is supported by a ridge end strut (152) and a post (154), each having brackets (156, 158) at their upper ends including fasteners (80) for attachment to the apex beam (22). The other end of the post (154) is fixed to an apex beam bracket (160) which includes fasteners (80) by which the apex beam bracket (160) connects to the apex beam (22). Likewise, the opposite end of the ridge end strut (152) includes brackets (162) with fasteners (80) for attachment to the apex beam (22) and the two rafters (23). The ridge beam (151) may be the same profile as the apex beam (22). The connection of the rafters (23) to the apex beam (22) may be by way of the rafter connection box node (72) as described with reference to FIG. 6.

FIG. 15A shows an exploded detail view of an exemplary ridge beam roof truss node (164) and FIG. 15 B shows an apex beam roof truss node (166). The bracket (158) with its fasteners (80) is shown in more detail in FIG. 15A, and in FIG. 15B the apex beam plate (160) is shown and the way in which the post (154) and a truss strut (168) connect to the plate (160). The nuts (82) and bolts (84) of the fasteners (80) are also illustrated in more detail.

FIGS. 16A, 16B and 16C illustrate an example of a corner outrigger node (170). An outrigger post (172) may be connected by way of an outrigger bracket (174) to the eaves beam corner node (100) as was described in connection with FIG. 9.

FIGS. 17A, 17B and 17C show an illustrative mid outrigger top node (176) and bottom node (178). By means of an additional outrigger bracket (180) that clamps onto the standard extrusion at the floor mid beam node (136), an outrigger post (182) is mounted. As shown in FIG. 17A, an outrigger strut (184) likewise connects by means of an outrigger bracket (186) at the eaves beam mid node (116). A rafter plate (188) is provided at the mid outrigger top node (176) for attachment by means of fasteners (80) to the rafter (23).

FIG. 18A shows an exemplary roof ridge (190) of the completed tensile membrane structure, with FIGS. 18B and 18C showing progressively more detail. The roof ridge (190) includes a ridge beam (151) which may have been rolled to have a curve according to the desired longitudinal shape of the roof ridge. In this example, the ridge beam (151) has the profile of the apex beam shown in FIG. 4. Note that multiple curved and rolled sections of ridge beam can be connected to give the desired shape.

The main roof membrane (16) is held within the slots (62) which in this embodiment are part-circular undercut slots. The end of the membrane (16) includes a bolt rope (192) held in place within a hem (194) in the membrane (16). The bolt rope (192) enables the edge of the membrane to be threaded into its slot (62) and secures it in place due to the slot being undercut and therefore having a smaller opening in the direction of the membrane (16) than the thickness of the bolt rope (192). To finish the roof ridge (190), a weatherproof cover strip (195) is provided. The cover strip (195) has a pair of clips (196) that locate the cover strip (195) in the lipped channel (60) of the ridge beam (151). The cover strip also includes a covering portion (197) sized to extend across a side of the beam, and a pair of flaps (198) fastened adjacent an edge of the covering portion. The pair of flaps (198) help deflect water away from the channels (60) and the interior of the structure, thereby weather proofing it. The flaps may be resilient such that they can deflect and yet remain pressed against the membrane, as is shown on the left-hand side of FIG. 18C where the membrane may have been deflected upwards by a force such as wind.

FIGS. 19A to 19C show a ceiling and tensioner system (199) for the hermetic membrane (24). The hermetic membrane (24) has a bolt rope edge which is held within one of the slots (62) of the apex beam (22). A fastener (80) is also shown in cross section in FIG. 19C. As shown in FIG. 19B, a tensioning bar (200) is provided which presses against the hermetic membrane (24). The tensioning bar (200) is urged away from the adjacent rafter (23) by a scissor jack (202) so as to tension the hermetic membrane (24). These components will, in preferred embodiments, be hidden from view by means of the inner ceilings (26) illustrated in FIG. 1.

In some embodiments, the system includes fabric walls that are also tensioned. FIGS. 20A to 20D illustrate one example of such walls and how they are able to be constructed. FIG. 20A is a plan view showing three walls (204) with a floor (206) visible from this above position. Shown in partial cutaway view is a floor substructure (208). FIGS. 20B and 20C show detail views of the two corners circled in FIG. 20A, with FIG. 20D showing a further detail portion. The corners are formed by columns (106) of the standard type of extrusion (12). Into the four externally facing channels (54) of the standard extrusion, wooden channel inserts (210) have been inserted, each held in place by a cooperating spring clip (212) as most clearly shown in FIG. 20D. The membrane wall (204) is tensioned towards the wooden channel inserts (210) and then stapled to them by means of a staple gun. To finish the details and hide the staples, cover strips (214) are provided, each cover strip (214) having a smooth top (216) forming a finished surface and a projection (218) opposite the smooth top (214) configured to be received in the groove (56) between the channels (54). An interior of the structure may be finished by means of a backing board (220) and optional upholstery (222). Structural insulated panels (224) may also be provided together with thermal block inserts (226) to improve the thermal properties of the walls.

FIGS. 21A to 21D show the fabric walls (204) in side elevation. As shown most clearly in FIG. 21D, the hermetic membrane (24) is held within the channel by a specialised keder rail termed a hermetic clip (228) that includes a slot (230) therein for receiving a bolt rope edge of the hermetic membrane (24). A stopper (232) fits into the hermetic clip (228) to hold it in place within the channel. In the lower of the two channels, a specialised keder rail termed a flyout clip (234) may be provided which receives a bolt rope edge of a flyout membrane (236). A stopper (238) fits into the flyout clip (234) to hold it in place within the channel and may also form a finishing detail. In the lower slot (58.2) of the beam, a bolt rope edge of the wall (204) is received. Finally, an aluminium cover (240) may slot into the groove (56) and may form a finishing surface to cover the hermetic clip (228) as previously described. A critter mesh (242) may be held in place by the aluminium cover (240) and may deter animals and insects from entering the roof spaces. Unused grooves (56) may be filled with thermal block inserts (244) so as to improve the thermal properties of the structure.

Having a mouth of the slot (58) in the same plane as a side of the beam may be important so that the wall (204) extends in the same plane as the side, since other edges of the wall will be stapled in the same plane as the sides. This is illustrated most clearly in FIG. 21D.

Figure 21B:
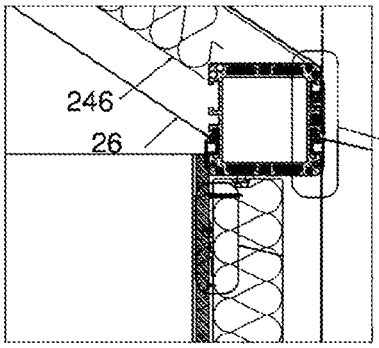
FIGS. 21A to 21D show the fabric walls in side elevation.
Figure 21C:
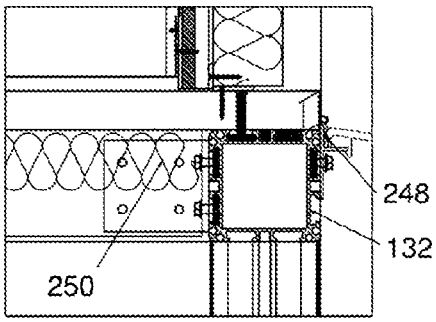
Figure 21D:
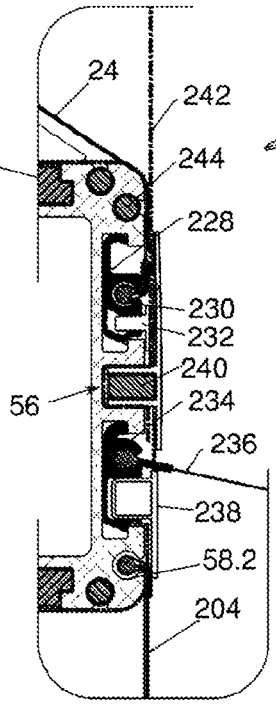
Figure 21A:
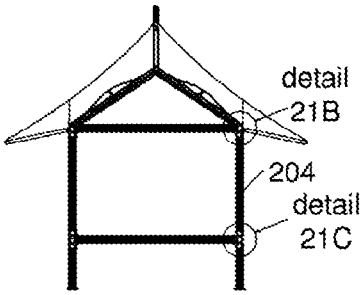

FIG. 21B also shows how the inner ceiling (26) attaches to the beam profile and shows the position of rigid insulated panels (246). FIG. 21C shows how a serrated wall tensioning mechanism (248) is mounted in a way that enables the walls (204) to be tensioned down, as well as the location of floor insulation (250).

Figure 22B:
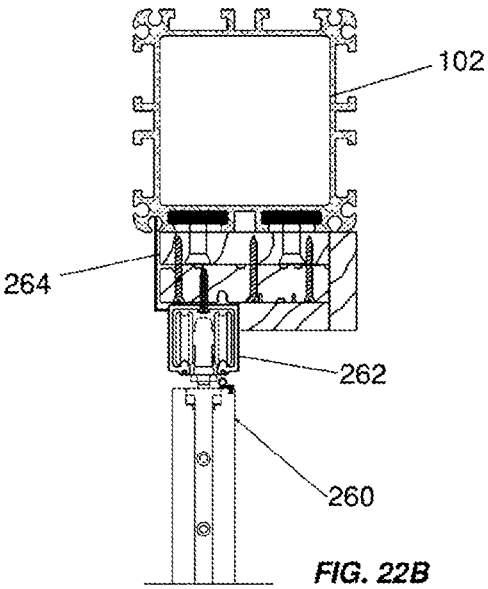
FIGS. 22A to 22D show folding and sliding door arrangements in side elevation.
Figure 22A:
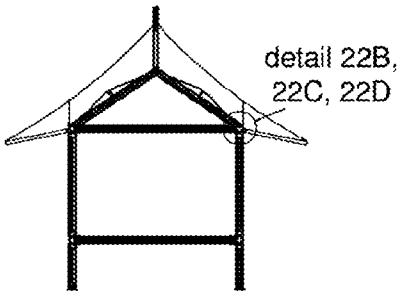
Figure 22C:
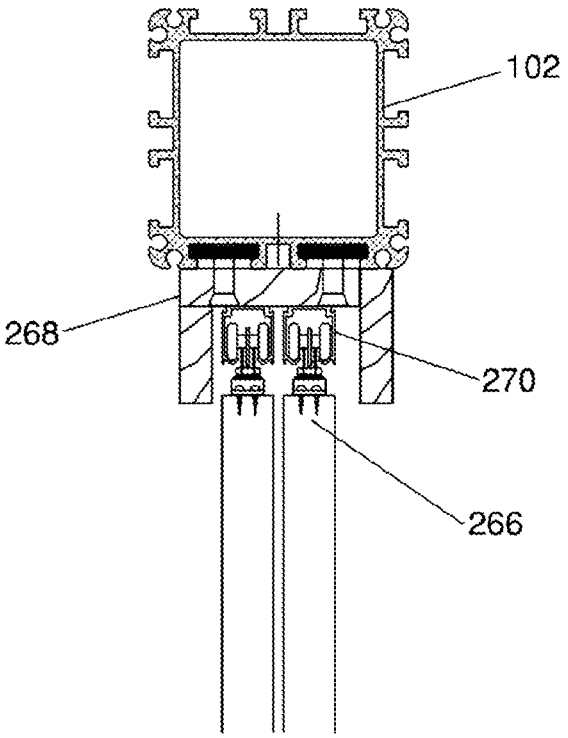
Figure 22D:
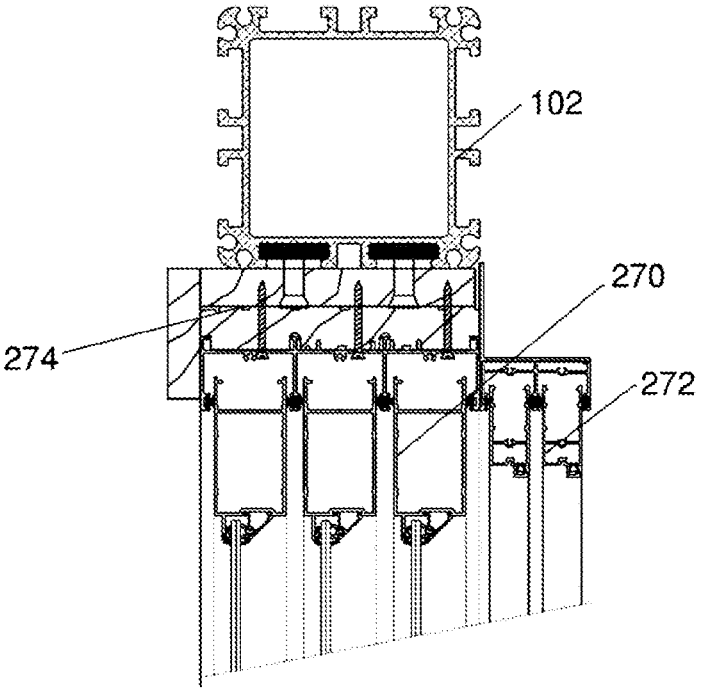

The system enables many different panels and components to be attached to the structural members. For example, instead of or in addition to fabric walls, structures such as sliding or folding doors can be accommodated. FIG. 22B shows a folding door (260) which is mounted on a rail (262) attached to a filler (264) which in turn is attached to two channels (54) in an eaves beam (102), the eaves beam (102) having the standard structural member profile (12). FIG. 22C shows how a sliding door (266) can be mounted to the eaves beam (102) using a different filler (268) and rail (270) arrangement. FIG. 22D shows a sliding door arrangement (270) with three sliding doors in a somewhat wider frame, and further including mesh screens (272). A wider filler (274) is provided to support this larger arrangement.

Figure 23B:
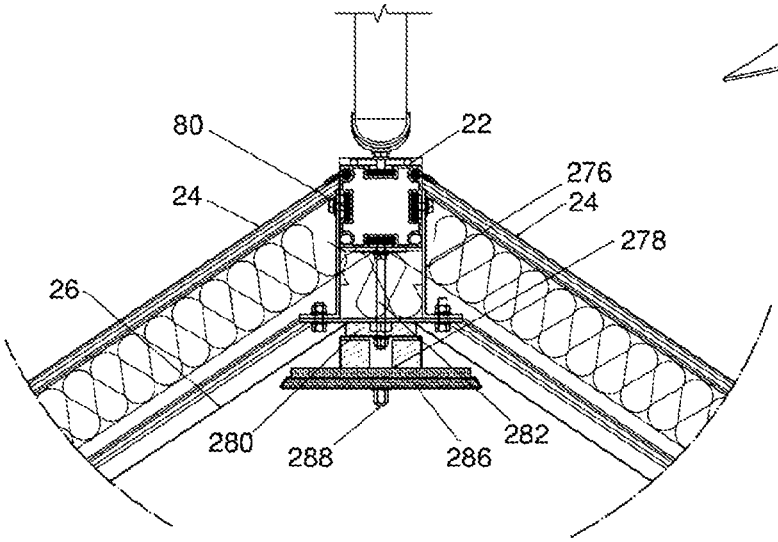
FIGS. 23A and 23B show how the hermetic membrane and inner ceiling can attach to the apex beam.
Figure 23A:
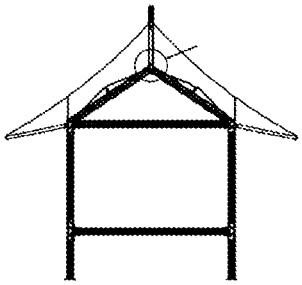

FIGS. 23A and 23B show how the hermetic membrane (24) and inner ceiling (26) may be attached to the apex beam (22). A bracket (276) is provided which attaches to the apex beam using the fasteners (80). A pull up system (278) is then used, the pull up system (278) including a block (280) which engages the fabric of the inner ceiling (26) and pulls it upwards by means of a bolt and nut arrangement (282). Finishing panels (286) hide the pull up system (278) and are secured in place by a dome nut (288).

The system thus described is flexible and able to be customized easily for many different designs while still using largely standard structural members, fasteners and other components. Assembly on site is quick and easy. The structural components, being primarily the standard structural members (12) are also the supports for all of the peripheral members and components to attach to, eliminating the need for different custom plates and fasteners for each tensile membrane structure design. The components can be machined and refined during manufacture to allow their attachment together on site.

The foregoing description has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

Finally, throughout the specification and accompanying claims, unless the context requires otherwise, the word 'comprise' or variations such as 'comprises' or 'comprising' will be understood to imply the inclusion of a stated integer or group of integers but not the exclusion of any other integer or group of integers.

The invention claimed is:

1. A tensile membrane structure comprising:

a framework supporting a membrane, wherein the framework includes a plurality of standard extruded structural members of a same cross-sectional profile, the cross-sectional profile of the standard extruded structural members being substantially rectangular with four sides oriented at right angles to each other at four corners, each side including formations that define at least one channel extending along a length of the standard extruded structural member by which the standard extruded structural members are interlocked using connectors that cooperate with the channels so as to form the framework, and each side further including two slots located on either side of the channel or channels towards the corners, the slots configured to receive and hold an edge of the membrane.

2. A tensile membrane structure building system comprising:

a membrane and a plurality of standard extruded structural members of a same cross-sectional profile, the cross-sectional profile of the standard extruded structural members being substantially rectangular with four sides oriented at right angles to each other at four corners, each side including formations that define at least one channel extending along a length of the standard extruded structural member by which the standard extruded structural members are interlocked using connectors that cooperate with the channels so as to form a framework, and each side further including two slots located on either side of the channel or channels towards the corners, the slots configured to receive and hold an edge of the membrane.

3. The tensile membrane structure building system as claimed in claim 2 wherein the cross-sectional profile of the standard extruded structural members is square, with the four sides being identical.

4. The tensile membrane structure building system as claimed in claim 2 wherein the slots are part-circular undercut slots, an end of the membrane includes a bolt rope, and the edge of the membrane is threaded into one of the part-circular undercut slots.

5. The tensile membrane structure building system as claimed in claim 2 including a weatherproof cover strip having a pair of clips that locate the cover strip in one of the channels, a covering portion sized to extend across one side of the standard extruded structural member, and a pair of flaps fastened adjacent an edge of the covering portion.

6. The tensile membrane structure building system as claimed in claim 2 including a channel insert with a cooperating spring clip for holding the channel insert in one of the channels, the channel insert being made from wood.

7. The tensile membrane structure building system as claimed in claim 2 including an extruded apex beam having a rectangular cross-sectional profile with four sides oriented at right angles to each other at four corners, each side including formations that define at least one channel extending along a length of the extruded apex beam by which the extruded apex beam is interlocked with the standard extruded structural members using connectors that cooperate with the channels of the extruded apex beam, and two opposite sides further including two slots located on either side of the channel or channels towards the corners, the slots configured to receive and hold an edge of a roof membrane or of a ceiling membrane.

8. The tensile membrane structure building system as claimed in claim 7 including an extruded ridge beam having a rectangular cross-sectional profile with four sides oriented at right angles to each other at four corners, each side including formations that define at least one channel extending along a length of the extruded ridge beam by which the extruded ridge beam is interlocked with the standard extruded structural members using connectors that cooperate with the channels of the extruded ridge beam, and two opposite sides further including two slots located on either side of two channels towards the corners, the slots configured to receive and hold an edge of the roof membrane.

9. The tensile membrane structure building system as claimed in claim 3 wherein the slots of the extruded apex beam and the slots of the extruded ridge beam are both larger than the slots of the standard extruded structural member so as to accommodate tensile forces in the roof membrane or the ceiling membrane.

10. The tensile membrane structure building system as claimed in claim 2 wherein each side has two adjacent channels extending along the length of the standard extruded structural member.

11. The tensile membrane structure building system as claimed in claim 10 including a longitudinally extending groove between the two adjacent channels.

12. The tensile membrane structure building system as claimed in claim 11 wherein the groove is ribbed.

13. The tensile membrane structure building system as claimed in claim 11, including a cover strip having a flat top forming a finished surface and a projection extending along an opposite bottom surface configured to be received in the groove.

14. The tensile membrane structure building system as claimed in claim 2 wherein the channels are inwardly lipped.

15. The tensile membrane structure building system as claimed in claim 14 wherein the connectors include plates or brackets having fasteners that cooperate with the inwardly lipped channels.

16. The tensile membrane structure building system as claimed in claim 15 wherein the fasteners include a nut and bolt, the nut having a lobed shape such that rotation of the nut engages the inwardly lipped channel so as to lock the nut within the channel.

17. The tensile membrane structure building system as claimed in claim 16 wherein the nut has a threaded bore for receiving an end of the bolt.

18. A method of building a tensile membrane structure comprising:

providing a plurality of standard extruded structural members of a same cross-sectional profile, the cross-sectional profile of the standard extruded structural members being substantially rectangular with four sides oriented at right angles to each other at four corners, each side including formations that define at least one channel extending along a length of the standard extruded structural member and two slots located on either side of the channel or channels towards the corners, interlocking the standard extruded structural members by means of connectors that cooperate with the channels to form a framework, and threading a bolt rope at an edge of a membrane into one of the slots, which receives and holds the membrane under tension.

* * * * *